US005962974A

United States Patent [19]

Komaki et al.

[11] Patent Number: 5,962,974

[45] Date of Patent: Oct. 5, 1999

[54] FACE-DISCHARGE AC DRIVING PLASMA DISPLAY PANEL

[75] Inventors: Toshihiro Komaki; Hiroyuki Mitomo; Masaomi Ebe, all of Yamanashi-ken, Japan

[73] Assignee: Pioneer Electronic Corporation, Tokyo, Japan

[21] Appl. No.: 08/939,916

[22] Filed: Sep. 29, 1997

[30] Foreign Application Priority Data

Oct. 4, 1996 [JP] Japan ..... 8-283180
Sep. 20, 1997 [JP] Japan ..... 9-239032

[51] Int. Cl.[6] ..... H01J 17/49

[52] U.S. Cl. ..... 313/582; 313/586; 313/587; 313/584

[58] Field of Search ..... 313/483–84, 582–87; 345/76, 80

[56] References Cited

U.S. PATENT DOCUMENTS 5,640,068 6/1997 Amemiya ..... 313/584 X
5,736,815 4/1998 Amemiya ..... 313/584 X
5,742,122 4/1998 Amemiya ..... 313/584 X

*Primary Examiner*—Sandra O'Shea
*Assistant Examiner*—Mack Haynes
*Attorney, Agent, or Firm*—Nikaido, Marmelstein, Murray & Oram LLP

[57] ABSTRACT

A plasma display panel comprises: a front glass base-plate provided on the front side of the plasma display panel; a rear glass base-plate provided on the rear side of the plasma display panel; a plurality of row electrode pairs provided on an internal surface of the front glass base-plate; a dielectric layer covering the row electrode pairs; a plurality of column electrodes provided on an internal surface of the rear glass base-plate. At least one electrode of each row electrode pair has a main body portion extending in a horizontal direction, and has a protruding portion in a unit luminous area. Further, each protruding portion consists of a transparent electrically conductive film and is formed into an isolated island in a unit luminous area.

6 Claims, 4 Drawing Sheets

| GLASS CODE | MAIN COMPONENTS | SOFTENING POINT (℃) | SPECIFIC DIELECTRIC CONSTANT |
|---|---|---|---|
| GA−4 | $Na_2O-B_2O_3-SiO_2$ | 625 | 6.2 |
| GA−12 | $Na_2O-B_2O_3-ZnO$ | 560 | 6.7 |
| LS−0500 | $Na_2O-B_2O_3-SiO_2$ | 585 | 7.6 |

| GLASS CODE | MAIN COMPONENTS | SOFTENING POINT (℃) | SPECIFIC DIELECTRIC CONSTANT |
|---|---|---|---|
| GA−4 | $Na_2O-B_2O_3-SiO_2$ | 625 | 6.2 |
| GA−12 | $Na_2O-B_2O_3-ZnO$ | 560 | 6.7 |
| LS−0500 | $Na_2O-B_2O_3-SiO_2$ | 585 | 7.6 |

FACE-DISCHARGE AC DRIVING PLASMA DISPLAY PANEL

BACKGROUND OF THE INVENTION

The present invention relates to a plasma display panel, in particular to a face-discharge AC driving plasma display panel.

Recently, it has been expected that a face-discharge AC driving plasma display panel can be utilized as a color-display apparatus having a large surface area but a small thickness. FIG. 7 is a cross sectional view indicating a cross sectional structure of such a face-discharge AC driving plasma display panel.

Referring to FIG. 7, a plurality of row electrode pairs 2,2 are provided on an internal surface of a front glass base-plate, a dielectric layer 3 is formed to cover the row electrode pairs 2, 2, a protection layer 4 of MgO is formed to cover the dielectric layer 3. In detail, each electrode 2 of a row electrode pair includes i) a transparent electrode 2*a* made of ITO or $SnO_2$ transparent film and having a relatively a large width, ii) an auxiliary metal electrode 2*b* (a bus electrode) made of a metal film having a relatively small width. Such a bus electrode 2*b* is provided to compensate for the electric conductivity of the transparent electrode 2*a*.

Referring again to FIG. 7, column electrodes 6 are provided on an internal surface of a rear glass base-plate 5, a fluorescent layer 7 is formed to cover the column electrodes 6.

In this way, the row electrodes 2 provided on the internal surface of the front glass base-plate 1 and the column electrodes 6 provided on the internal surface of the rear glass base-plate 5 are arranged to be orthogonal with each other. An electric discharge space 8 is formed between the front glass base-plate 1 and the rear glass base-plate 5. A rear gas is introduced and sealed into the discharge space 8. Thus, each intersection formed by a row electrode 2 and a column electrode 6 serves as a center for the formation of a picture element (unit luminous area).

The above dielectric layer 3 is formed by coating the row electrodes 2 with a low melting point glass paste containing PbO followed by calcination. Further, since an electric resistance should be low in order to compensate for an electric conductivity of the transparent electrode 2*a*, the metal film for forming the auxiliary metal electrode 2*b* is required to contain Al or Al alloy.

FIG. 8 is an enlarged explanatory view illustrating row electrode pairs when viewed on a display side of a plasma display panel.

Referring to FIG. 8, each row electrode 2 includes a transparent electrode 2*a* and a bus electrode 2*b* laminated over the transparent electrode 2*a*. In each unit luminous area 12, a pair of transparent electrodes 2*a*, 2*a* have a pair of protruding portions 10, 10 which are facing each other through an electric discharge gap 11.

However, there are at least the following problems with the conventional plasma display panel shown in FIGS. 7 and 8. Namely, If the above dielectric layer 3 is formed by a low melting point glass containing PbO, such a dielectric layer 3 will react with the auxiliary metal electrode 2*b*, undesirably generating gas bubbles on an interface therebetween. Such gas bubbles will in fact cause the thickness of the dielectric layer 3 to become partially thinner, resulting in an undesired discharge due to a deterioration of high voltage durability. Consequently, the electric insulating property of the dielectric layer 3 will be damaged. Moreover, since the dielectric layer 3, which contains lead oxide (PbO) as a main component, has a relatively large specific dielectric constant 9–12, the cell capacity thereof is relatively large, so that the discharging current is needed to be large, resulting in a high consumption in electric power.

In order to solve the above problem, it has been suggested that the dielectric layer 3 be formed of a low melting point glass which contains an alkali glass as a main component and has a lower dielectric constant. However, during the calcination of an alkali glass, when glass material having a high ion-conductivity gets in contact with the transparent electrically conductive film which constituting the transparent electrode 2*a*, it is possible that the transparent electrically conductive film, the alkali glass and the aluminium will form a local battery system, hence corroding and discoloration (blackening) the transparent electrically conductive film, deteriorating the luminous efficiency.

SUMMARY OF THE INVENTION

It is an object of the present invention to provide an improved plasma display panel capable of preventing the generation of gas bubbles and the discoloration of transparent electrically conductive films, so as to solve the above-mentioned problems peculiar to the above-mentioned prior arts According to the present invention, there is provided a plasma display panel which comprises: a front glass base-plate provided on the front side of the plasma display panel; a rear glass base-plate provided on the rear side of the plasma display panel; a plurality of row electrode pairs provided on an internal surface of the front glass base-plate, said row electrode pairs being arranged in a horizontal direction; a dielectric layer covering the row electrode pairs; a plurality of column electrodes provided on an internal surface of the rear glass base-plate, said column electrodes being arranged in a direction orthogonal to the above horizontal direction to form a plurality of intersections with the row electrode pairs, each of said intersections serving as a unit luminous area. In detail, at least one electrode of each row electrode pair has a main body portion extending in the above horizontal direction, and a protruding portion in each unit luminous area, said protruding portion being protruding from the main body portion in the same direction in which column electrodes are arranged. In particular, each protruding portion consists of a transparent electrically conductive film and is formed into an isolated island in a unit luminous area. Further, the main body portion contains a metal film, the metal film is electrically connected with an edge portion of the transparent electrically conductive film opposite to and away from a discharge gap formed between two protruding portions in a unit luminous area.

In one aspect of the present invention, the main body portion contains a metal film and a transparent electrically conductive film laminated over the metal film, the transparent electrically conductive film of the main body portion is separated from the transparent electrically conductive film of the protruding portion, thereby forming at least one isolated island in a unit luminous area.

In another aspect of the present invention, each protruding portion includes a wide portion adjacent to a discharge gap, and a narrow portion connecting with the wide portion.

In a further aspect of the present invention, the transparent electrically conductive film is made of ITO, the metal film is made of aluminium or an aluminium alloy.

In a still further aspect of the present invention, said dielectric layer is made of a low melting point glass whose ion-conductivity will increase upon calcination.

The above objects and features of the present invention will become more understood from the following description with reference to the accompanying drawings.

DETAILED DESCRIPTION OF THE PREFERRED EMBODIMENTS

Figures 1, 2:
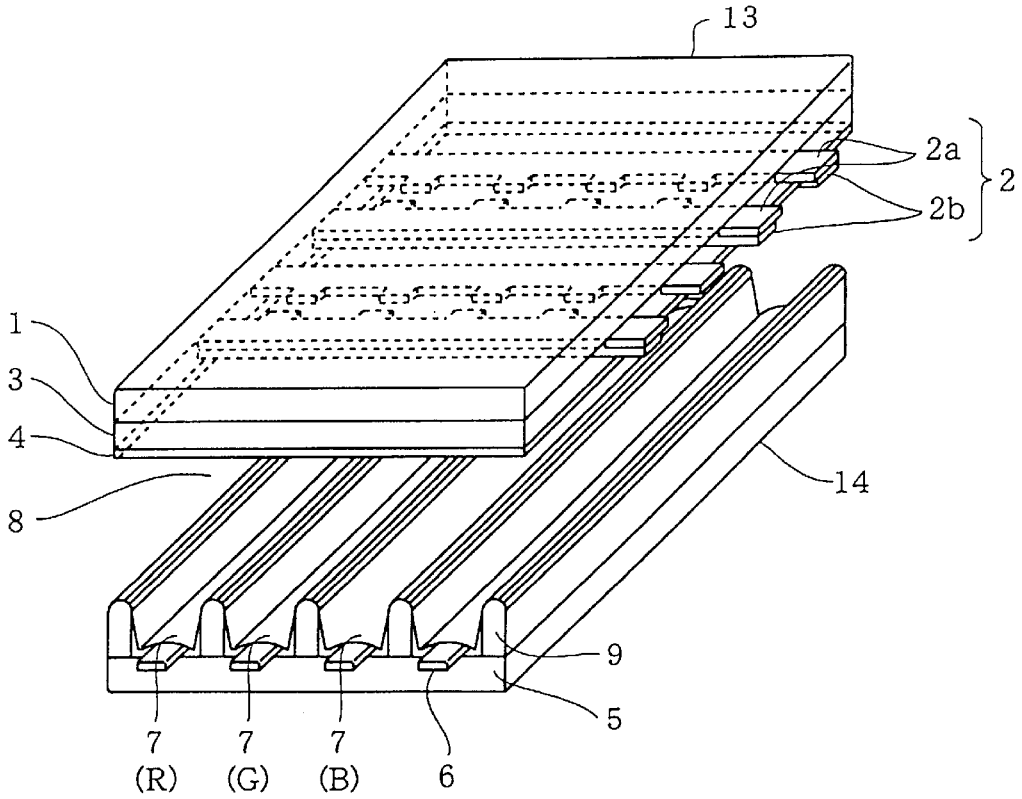
FIG. 1 is a perspective view illustrating a plasma display panel according to the present invention.
FIG. 2 is a table indicating a relationship between softening point and specific dielectric constant of each low melting point glass.

In FIGS. 1–6 showing plasma display panels according to the present invention, the same elements as those in the above prior art drawings are represented by the same reference numerals.

Referring to FIG. 1, the plasma display panel of the present invention has a front base section 13 and a rear base section 14. On the internal surface of a front glass base-plate 1 of the front base section 13, there are provided a plurality of row electrode pairs 2 which are arranged in parallel with each other in a horizontal direction. Each row electrode 2 includes a transparent electrode 2*a* and a bus electrode 2*b*. The transparent electrode 2*a* comprises a transparent electrode film having a thickness of several thousand Angustroms which is formed by the deposition of a mixture containing indium oxide and tin oxide ($SnO_2$). The bus electrode 2*b* comprises a laminated metal film of aluminium or aluminium alloy to increase the electric conductivity of the transparent electrode 2*a*. Each row electrode 2 includes a main body portion extending in a horizontal direction and a plurality of protruding portions extending in a direction orthogonal to the horizontal direction. Namely, in each unit luminous area, each pair of row electrodes have a pair of protruding portions which are facing each other through an electric discharge gap. In this way, a pair of transparent electrodes consisting of a transparent electrode film and having such a pair of protruding portions, is separated from each other in each unit luminous area.

Further, a dielectric layer 3 is formed on the row electrodes 2. The dielectric layer 3, which has a thickness of 20–50 $\mu$m, is formed by a low melting point glass whose ion-conductivity will increase upon calcination. Moreover, a protection layer 4, which is magnesium oxide (MgO), is formed on the dielectric layer 3.

In particular, the dielectric layer 3 is formed by a low melting point alkali glass having a dielectric constant of 8 or less. Thus, the dielectric layer has a softening point of 650° C. or lower. In detail, the low melting point glass for forming the dielectric layer 3 contains at least sodium oxide ($Na_2O$) and boron oxide ($B_2O_3$). Several commercially available low melting point glasses are manufactured by Nippon Electric Glass Co. Ltd., having their various properties indicated in a table of FIG. 2.

On the other hand, provided on the internal surface of a rear glass base-plate 5 of the rear base section 14 are a plurality of column electrodes 6 which are arranged in a direction orthogonal to the row electrodes 2, so that each intersection formed by a row electrode 2 and a column electrode 6 constitutes a unit luminous area. In detail, every two column electrodes 6 are separated from each other by a spacer rib 9, and all these column electrodes 6 are coated respectively with three original colors 7 which are Red (R), Green (G) and Blue (B), as illustrated in FIG. 1.

An electric discharge space 8 is formed between the front glass base-plate 1 and the rear glass base-plate 5. As shown in FIG. 1, with the use of the spacer ribs 9, the discharge space 8 is divided into a plurality of smaller cells corresponding to the unit luminous areas. Then, an electric discharge gas containing neon and xenon is introduced and sealed into the space 8.

Figure 3:
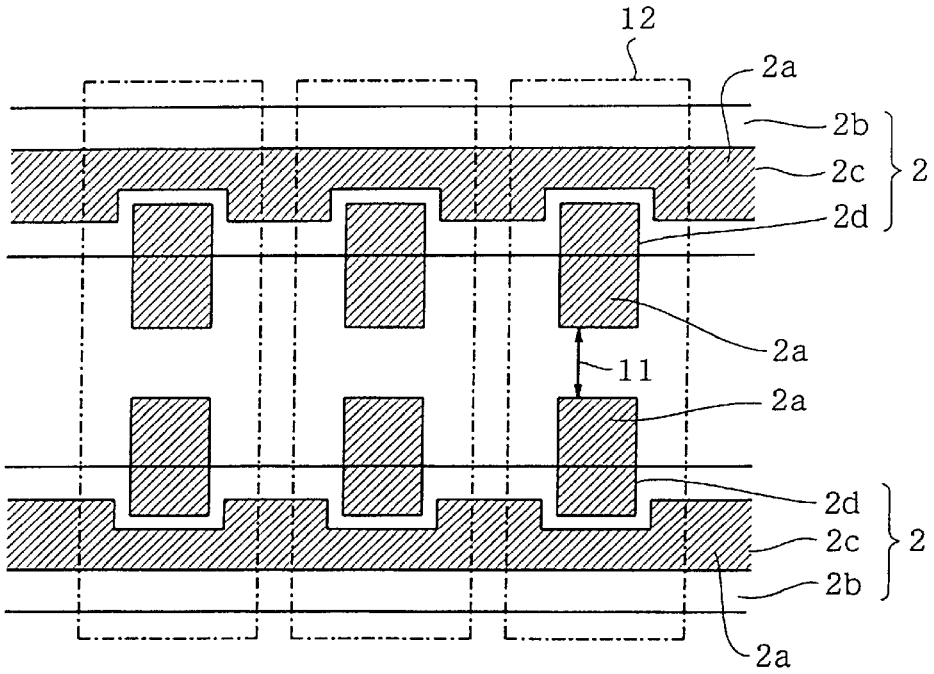
FIG. 3 is an enlarged explanatory view illustrating row electrode pairs of a plasma display panel according to a first embodiment of the present invention.

FIG. 3 is an enlarged plane view indicating a first embodiment of a plasma display panel according to the present invention.

Referring to FIG. 3, each row electrode 2 has a main body portion 2*c* extending in a horizontal direction (as viewed in FIG. 3), and a plurality of protruding portions 2*d* each protruding from the main body portion 2*c* in a direction orthogonal to the above horizontal direction. In fact, each protruding portion 2*d* is located in a unit luminous area 12, so that two protruding portions 2*d*, 2*d* protruding from a pair of row electrodes 2, 2 are facing each other through a discharge gap 11 in a unit luminous area 12. In this way, a transparent electrode 2*a* consisting of a transparent electrode film which constitutes protruding portions 2*d*, is separated from the transparent electrode 2*a* which constitutes the main body portion 2*c*, thereby forming an isolated island. As a result, there are formed two such isolated islands in each unit luminous area 12.

On the other hand, each of the above main body portion 2*c* comprises i) a transparent electrode 2*a* consisting of a transparent electrode film extending in the above-mentioned horizontal direction (as viewed in FIG. 3), which is separated from the transparent electrode 2*a* constituting the protruding portion 2*d*, ii) a bus electrode 2*b* consisting of a metal film in a belt-like form extending in the same horizontal direction, which is laminated over the transparent electrode 2*a*. A bus electrode 2*b* is laminated in a manner such that it covers edge portion of a transparent electrode 2*a* (constituting the protruding portion 2*d*) opposite to and away from the discharge gap 11 and it also covers the transparent electrode 2*a* constituting the main body portion 2*c*. Further, an edge portion of the transparent electrode 2*a* (consisting of a transparent electrically conductive film and constituting the protruding portion 2*d*) opposite to and away from the discharge gap 11 is electrically connected with the bus electrode 2*b* consisting of a metal film which constitutes a main body portion 2*c*.

In this way, each transparent electrode 2*a* constituting a protruding portion 2*d*, is separated in each unit luminous area 12 from the transparent electrode 2*a* constituting the main body portion 2*c*, thus becoming an isolated island. The protruding portion 2*d* of the transparent electrode and the main portion 2c are electrically connected with each other by bus electrode 2b. As a result, it is possible to reasonably disperse the electrode effects produced by both the transparent electrode and the bus electrode, thereby effectively preventing discoloration of the transparent electrode and generation of gas bubble within the dielectric layer.

In addition, the main body portion 2c of the transparent electrode 2a also has an effect to prevent reflection, thus greatly reducing an undesired reflection caused by the bus electrode which has a relatively higher reflectivity.

Figure 4:
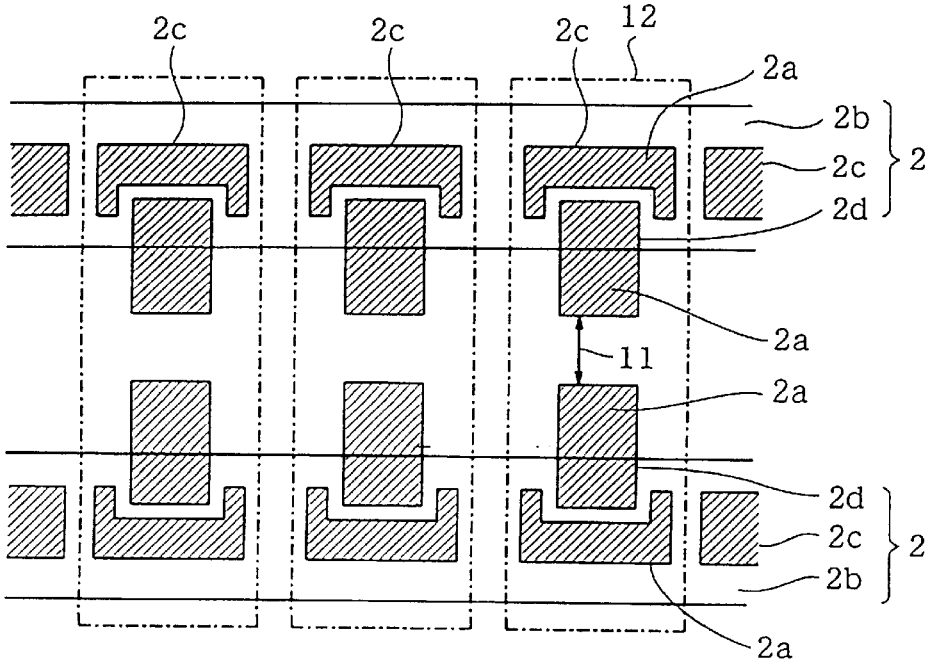
FIG. 4 is an enlarged explanatory view illustrating row electrode pairs of a plasma display panel according to a second embodiment of the present invention.

FIG. 4 is an enlarged plane view indicating a second embodiment of a plasma display panel according to the present invention.

Referring to FIG. 4, each row electrode 2 has a main body portion 2c extending in a horizontal direction (as viewed in FIG. 4), and a plurality of protruding portions 2d protruding from the main body portion 2c in a direction orthogonal to the above horizontal direction. In fact, each protruding portion 2d is located in a unit luminous area 12, so that two protruding portions 2d, 2d protruding from a pair of row electrodes 2, 2 are facing each other through a discharge gap 11 in a unit luminous area 12. In this way, a transparent electrode 2a consisting of a transparent electrode film which constitutes protruding portions 2d, is separated from the transparent electrode 2a which constitutes the main body portion 2c, thereby forming an isolated island. As a result, there are formed two such isolated islands in each unit luminous area 12.

On the other hand, the above main body portion 2c is separated from a transparent electrode 2a constituting a protruding portion 2d in a unit luminous area. In detail, the main body portion 2c comprises i) a transparent electrode 2a consisting of a transparent electrode film and formed into several isolated islands, ii) a bus electrode 2b consisting of a metal film in a belt-like form extending in the same horizontal direction, which is laminated over the above transparent electrode 2a. A bus electrode 2b is laminated in a manner such that it covers edge portion of a transparent electrode 2a (constituting the protruding portion 2d) opposite to and away from the discharge gap 11 and it also covers the transparent electrode 2a constituting the main body portion 2c. Further, an edge portion of the transparent electrode 2a (consisting of a transparent electrically conductive film and constituting the protruding portion 2d) opposite to and away from the discharge gap 11 is electrically connected with the bus electrode 2b consisting of a metal film which constitutes the main body portion 2c.

In this way, each transparent electrode 2a constituting a protruding portion 2d, is separated in each unit luminous area 12 from the transparent electrode 2a constituting a main body portion 2c. Further, each transparent electrode 2a constituting the main body portion 2c is in isolated condition in a unit luminous area 12. In this manner, the main body portions 2c and protruding portions 2d are separated from each other, producing independent isolated islands in each unit luminous area 12. As a result, it is possible to reasonably disperse the electrode effects produced by both the transparent electrode and the bus electrode, thereby effectively preventing discoloration of the transparent electrode and generation of gas bubble within the dielectric layer.

Figure 5:
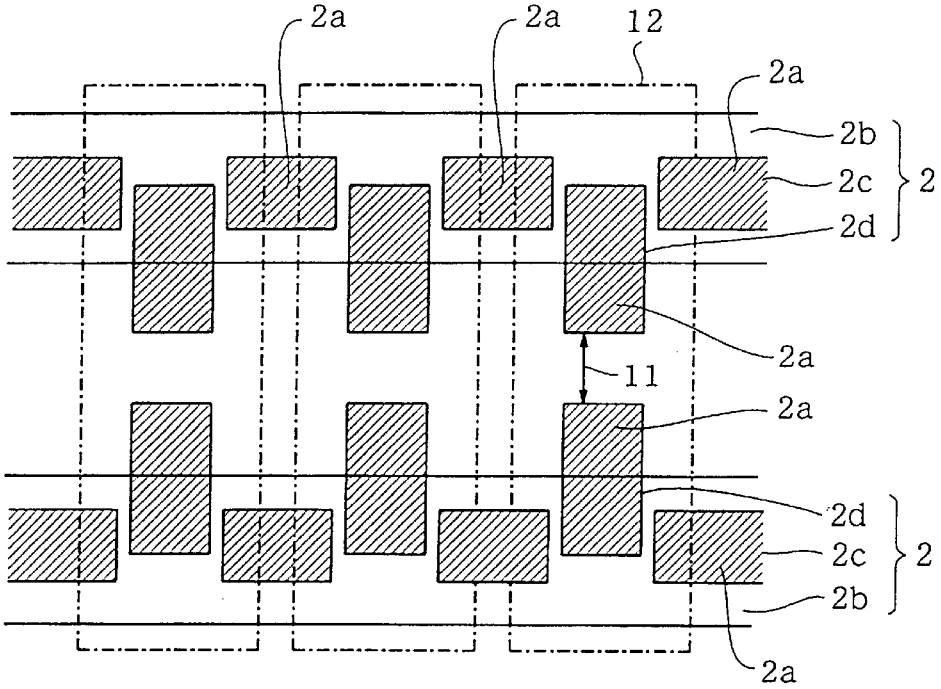
FIG. 5 is an enlarged explanatory view illustrating row electrode pairs of a plasma display panel according to a third embodiment of the present invention.

FIG. 5 is an enlarged plane view indicating a third embodiment of a plasma display panel according to the present invention.

Referring to FIG. 5, each row electrode 2 has a main body portion 2c extending in a horizontal direction (as viewed in FIG. 5), and a plurality of protruding portions 2d each protruding from the main body portion 2c in a direction orthogonal to the above horizontal direction. In fact, each protruding portion 2d is located in a unit luminous area 12, so that two protruding portions 2d, 2d extending from a pair of row electrodes 2, 2 are facing each other through a discharge gap 11 in a unit luminous area 12. In this way, a transparent electrode 2a consisting of a transparent electrode film which constitutes a protruding portion 2d, is separated from a transparent electrode 2a which constitutes the main body portion 2c, thereby forming an isolated island. As a result, there are formed two such isolated islands in each unit luminous area 12.

On the other hand, in a unit luminous area, a main body portions 2c is separated from a transparent electrode 2a constituting a protruding portion 2d. In detail, a main body portion 2c comprises i) a transparent electrode 2a consisting of a transparent electrode film and formed into isolated islands, ii) a bus electrode 2b consisting of a metal film in a belt-like form extending in the horizontal direction (as viewed in FIG. 5) which is laminated over the above transparent electrode 2a. A bus electrode 2b is laminated in a manner such that it covers edge portion of a transparent electrode 2a (constituting the protruding portion 2d) opposite to and away from the discharge gap 11 and it also covers the transparent electrode 2a constituting the main body portion 2c. Further, an edge portion of the transparent electrode 2a (consisting of a transparent electrically conductive film and constituting the protruding portion 2d) opposite to and away from the discharge gap 11 is electrically connected with the bus electrode 2b consisting of a metal film which constitutes a main body portion 2c.

In this way, each transparent electrode 2a constituting a protruding portion 2d, is separated in each unit luminous area 12 from the transparent electrode 2a constituting the main body portion 2c. Further, a transparent electrode 2a constituting a main body portion 2c is in isolated condition. In this manner, a main body portion 2c and a protruding portion 2d are separated from each other, producing independent isolated islands in each unit luminous area 12. As a result, it is possible to reasonably disperse the electrode effects produced by both the transparent electrode and the bus electrode, thereby effectively preventing discoloration of the transparent electrode and generation of gas bubble within the dielectric layer.

Figure 6:
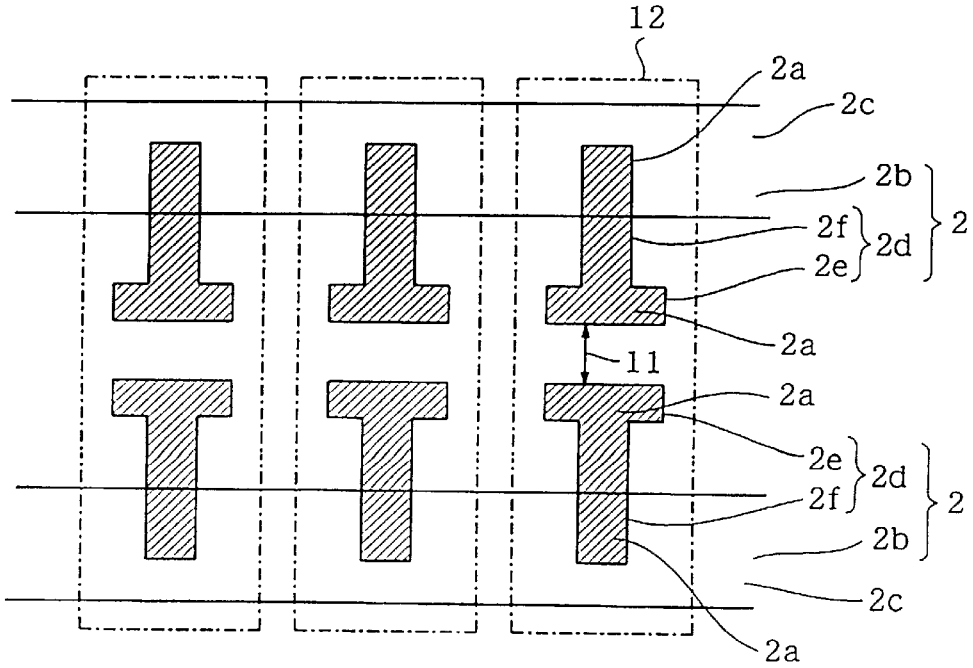
FIG. 6 is an enlarged explanatory view illustrating row electrode pairs of a plasma display panel according to a fourth embodiment of the present invention.
Figure 7:
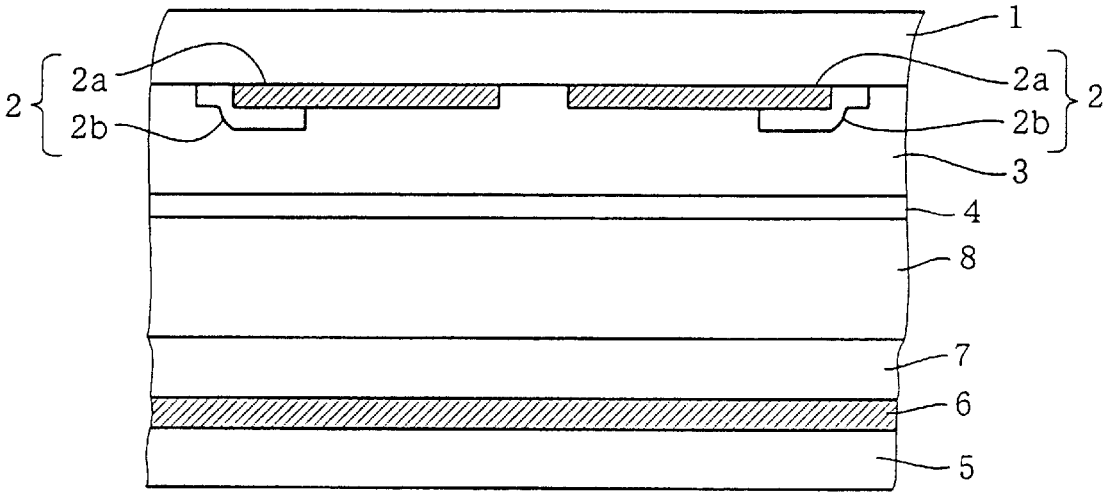
FIG. 7 PRIOR ART
FIG. 7 is a cross sectional view indicating a cross sectional structure of a conventional plasma display panel.
Figure 8:
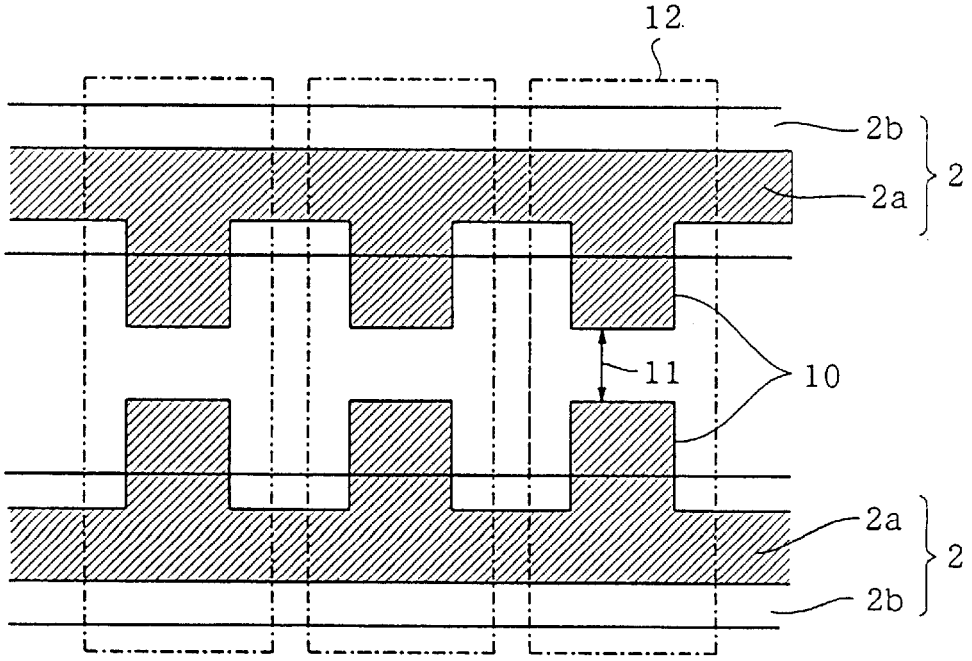
FIG. 8 PRIOR ART
FIG. 8 is an enlarged explanatory view illustrating row electrode pairs when viewed on a display side of the conventional plasma display panel of FIG. 7.

FIG. 6 is an enlarged plane view indicating a fourth embodiment of a plasma display panel according to the present invention.

Referring to FIG. 6, each row electrode 2 has a main body portion 2c extending in a horizontal direction (as viewed in FIG. 3), and a plurality of protruding portions 2d each extending from the main body portion 2c in a direction orthogonal to the above horizontal direction. In fact, each protruding portion 2d is located in a unit luminous area 12, so that two protruding portions 2d, 2d extending from a pair of row electrodes 2, 2 are facing each other through a discharge gap 11 in a unit luminous area 12. In this way, a transparent electrode 2a consisting of a transparent electrode film which constitutes a protruding portion 2d, is separated from other portions in a unit luminous area 12, thereby forming an isolated island. As shown in FIG. 5, a transparent electrode 2a constituting a protruding portion 2d is formed into a T-shape having an enlarged portion 2e adjacent to a discharge gap 11, and a narrow portion 2f connecting with the enlarged portion 2e.

On the other hand, each main body portion 2c comprises a bus electrode 2b consisting of a metal film in a belt-form extending in a horizontal direction (as viewed in FIG. 6), which is laminated on an edge portion of a transparent electrode 2*a* (consisting of a transparent electrode film and constituting a protruding portion 2*d*) opposite to and away from a discharge gap 11. Further, a bus electrode 2*b* is electrically connected with an edge portion of an transparent electrode 2*a* (consisting of a transparent electrically conductive film and constituting the protruding portion 2*d*) opposite to and away from a discharge gap 11.

In this way, a transparent electrode 2*a* constituting a protruding portion 2*d* is formed into an isolated island in a unit luminous area 12, and a contacting area between a transparent electrode 2*a* and a bus electrode 2*b* (consisting of a metal film and constituting a main body portion 2*c*) is reduced. As a result, it is possible to prevent a battery effect between a transparent electrode and a bus electrode, thereby effectively preventing a discoloration of the transparent electrode and generation of gas bubble within the dielectric layer.

While the presently preferred embodiments of the this invention have been shown and described above, it is to be understood that these disclosures are for the purpose of illustration and that various changes and modifications may be made without departing from the scope of the invention as set forth in the appended claims.

What is claimed is:

1. A plasma display panel comprising:

a front glass base-plate provided on the front side of the plasma display panel;

a rear glass base-plate provided on the rear side of the plasma display panel;

a plurality of row electrode pairs provided on an internal surface of the front glass base-plate, said row electrode pairs being arranged in a horizontal direction;

a dielectric layer covering the row electrode pairs;

a plurality of column electrodes provided on an internal surface of the rear glass base-plate, said column electrodes being arranged in a direction orthogonal to the above horizontal direction to form a plurality of intersections with the row electrode pairs, with each intersection serving as a unit luminous area;

wherein at least one electrode of each row electrode pair has a main body portion extending in the above horizontal direction, and a protruding portion in each unit luminous area, said protruding portion being protruded from the main body portion in the same direction in which column electrodes are arranged;

wherein each protruding portion consists of a transparent electrically conductive film and is formed into an isolated island in a unit luminous area, said protruding portion being electrically connected to said main body portion;

wherein the main body portion contains a metal film, the metal film is electrically connected with an edge portion of the transparent electrically conductive film opposite to and away from a discharge gap formed between two protruding portions in a unit luminous area.

2. A plasma display panel according to claim 1, wherein the main body portion contains a metal film and a transparent electrically conductive film laminated over the metal film, the transparent electrically conductive film of the main body portion is separated from the transparent electrically conductive film of the protruding portion, thereby forming at least one isolated island in a unit luminous area.

3. A plasma display panel according to claim 2, wherein the transparent electrically conductive film of the main body portion is formed into at least one isolated island in a unit luminous area.

4. A plasma display panel according to claim 1, wherein each protruding portion includes a wide portion adjacent to a discharge gap, and a narrow portion connecting with the wide portion.

5. A plasma display panel according to any one of preceding claims, wherein the transparent electrically conductive film is made of ITO, the metal film is made of aluminium or an aluminium alloy.

6. A plasma display panel according to claim 1, wherein said dielectric layer is made of a low melting point glass whose ion-conductivity will increase upon calcination.

* * * * *